US005661488A

United States Patent [19]

Kudo

[11] Patent Number: 5,661,488

[45] Date of Patent: Aug. 26, 1997

[54] ANTENNA DRIVE APPARATUS EQUIPPED WITH A STEPPING MOTOR

[75] Inventor: Masato Kudo, Tokyo, Japan

[73] Assignee: Kabushiki Kaisha Toshiba, Kawasaki, Japan

[21] Appl. No.: 492,764

[22] Filed: Jun. 21, 1995

[51] Int. Cl.[6] ..... H01Q 3/00

[52] U.S. Cl. ..... 342/35.9; 342/426; 343/757

[58] Field of Search ..... 342/359, 426, 342/75; 343/757

[56] References Cited

U.S. PATENT DOCUMENTS

| | | | |
|---|---|---|---|
| 3,842,420 | 10/1974 | Rabow | 343/117 R |
| 4,035,805 | 7/1977 | Mobley | 343/117 R |
| 4,630,056 | 12/1986 | Noguchi et al. | 342/357 |
| 4,912,476 | 3/1990 | Miller et al. | 342/359 |
| 5,241,319 | 8/1993 | Shimizu | 342/358 |
| 5,300,935 | 4/1994 | Yu | 342/355 |

FOREIGN PATENT DOCUMENTS

| | | |
|---|---|---|
| 2-142396 | 5/1990 | Japan . |

*Primary Examiner*—Thomas H. Tarcza
*Assistant Examiner*—Dao L. Phan
*Attorney, Agent, or Firm*—Oblon, Spivak, McClelland, Maier & Neustadt, P.C.

[57] ABSTRACT

An apparatus is disclosed which computes the full-step number of full-step drive pulses at each control period, generates microstep drive pulses on the basis of the full step number so as to make a drive angle at each control period correspond to a full-step unit, and drives a motor drive current on the basis of the microstep drive pulses.

6 Claims, 4 Drawing Sheets

ANTENNA DRIVE APPARATUS EQUIPPED WITH A STEPPING MOTOR

BACKGROUND OF THE INVENTION

1. Field of the Invention

The present invention relates to an antenna drive apparatus for use in orientation-controlling an antenna, such as an antenna system for optical communication, in a desired direction.

2. Description of the Related Art

Usually, a stepping motor has been used as a drive source in an antenna drive apparatus and, by the stepping motor, the antenna can be orientation-controlled with high accuracy. In the stepping-motor it is possible to compute a drive angle (full-step angle) from a product of a step angle and drive pulse number as shown in FIG. 4. By doing so, the stepping motor can have its rotation stopped to a predetermined position without being magnetically excited, that is, through the utilization of the so-called detent torque, and be held to a "power OFF" position corresponding to a non-excited state, thus ensuring accurate reproducibility.

With the antenna drive apparatus, on the other hand, the stepping motor is intermittently driven by drive pulses corresponding to those into which a drive current is converted (see FIG. 4), that is by the so-called full-step drive pulses, to enable the antenna to be orientation-controlled. However, at each drive of the motor, great vibration is exerted on the antenna due to a disturbance caused by the motor drive, thus exerting a bad influence on stable orientation control.

In the antenna drive apparatus, the stepping motor is driven by microstep drive pulses corresponding to those into which the step angle is divided as shown in FIG. 5. By doing so, the so-called microstep drive system is adopted to achieve a smooth motor drive. The use of this system can reduce vibration caused in the antenna due to disturbance upon the driving of the motor. The microstep drive pulses are generated as pulses to which a drive current is converted as a pulse equivalent.

The above-mentioned microstep drive system, however, cannot utilize a detent torque at each step and, when the stepping motor is turned OFF, then the stepping motor is sometimes stopped to a position not just corresponding to the step angle involved (a position as indicated by a broken line in FIG. 4), thus failing to achieve its reproducibility.

In this case, any accurate control is difficult to achieve unless a position control system is provided so as to ensure the continuous supply of electric current at all times without cutting off the power source. This system involves more dissipation power. Further it is also necessary to consider the control of heat generated during operation. Cumbersome handling is required in this respect.

SUMMARY OF THE INVENTION

It is accordingly the object of the present invention to provide an antenna drive apparatus which can achieve highly accurate, smoothly stable antenna orientation control in a simple structure and is easy to handle.

According to the present invention there is provided an antenna drive apparatus, comprising: a stepping motor for antenna orientation; a control unit for computing the number of full-step drive pulses for driving that antenna at each control period of the stepping motor and, in order to make a drive angle at each control period correspond to a full-step unit, generating microstep drive pulses on the basis of the computed full-step drive pulse number; and a drive unit for driving the stepping motor by the microstep drive pulses generated from the control unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

The embodiment of the present invention will be explained in more detail below with reference to the accompanying drawings.

Figure 1:
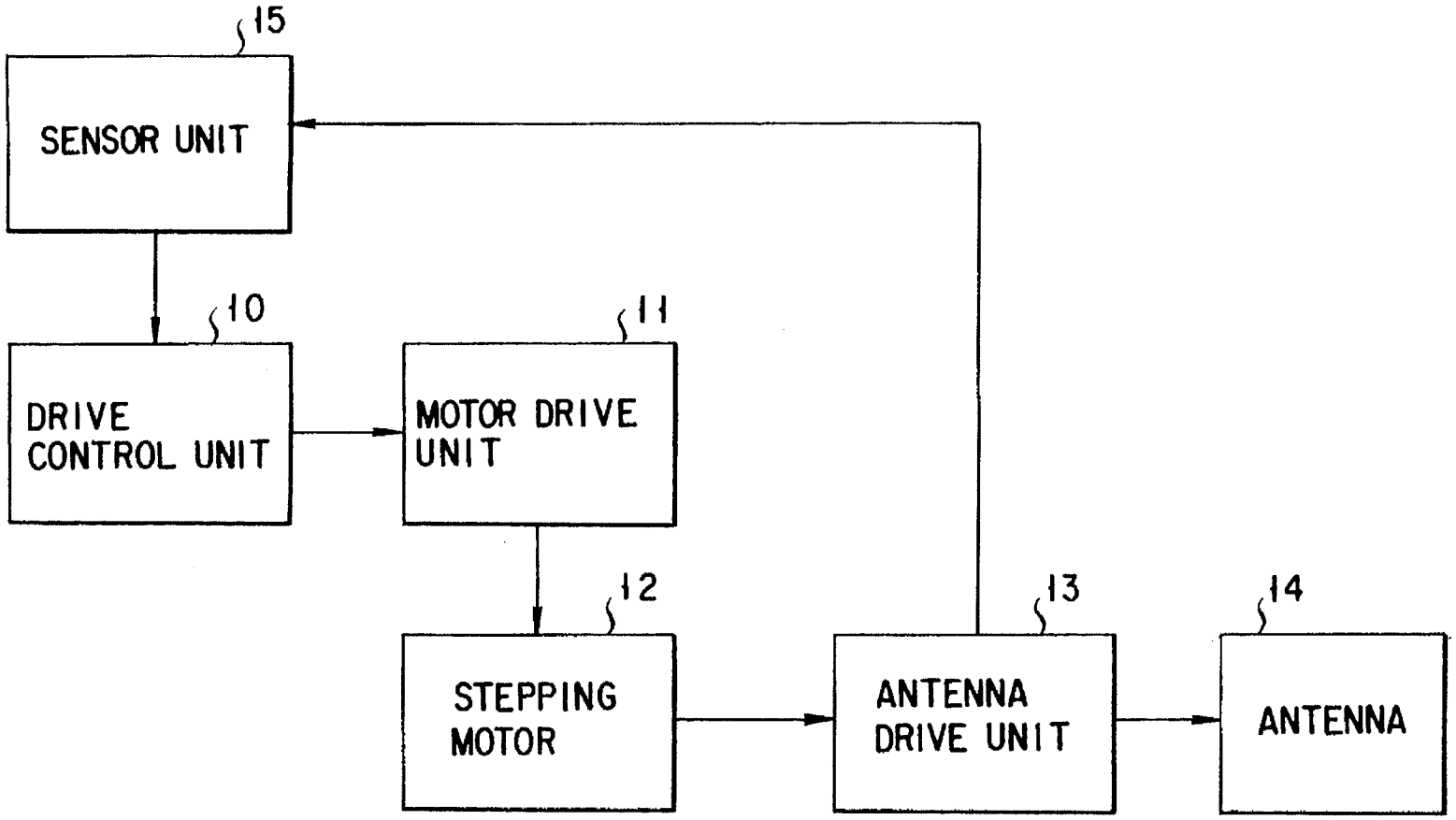
FIG. 1 is a block diagram showing an antenna drive apparatus according to an embodiment of the present invention.

FIG. 1 shows an antenna drive apparatus according to one embodiment of the present invention. An input terminal of a motor drive unit 11 is connected to a drive control unit 10. A stepping motor 12 is connected to an output terminal of the motor drive unit 11 and a movable antenna drive unit 13 is connected to the stepping motor 12. A movable antenna 14 is mounted on the antenna drive unit 13 and, upon receiving a drive torque from the stepping motor 12, is so moved as to be oriented in a desired direction.

The output of the antenna drive unit 13 is input to a sensor unit 15. The sensor unit 15 receives an output from the antenna drive unit 10 and computes a corresponding drive amount of the antenna 14.

The output of the sensor unit 15 is input to the drive control unit 10 and the drive control unit 13 is controlled by the output of the antenna drive unit 13, that is, the drive amount of the antenna 14.

The operation of the present embodiment will be explained below in more detail below with reference to FIGS. 2 and 3.

In the present embodiment, a drive angle ratio between a full-step drive pulse and a microstep drive pulse is so set as set out below.

1 full-step drive angle: 1 microstep drive=8:1

Figure 2:
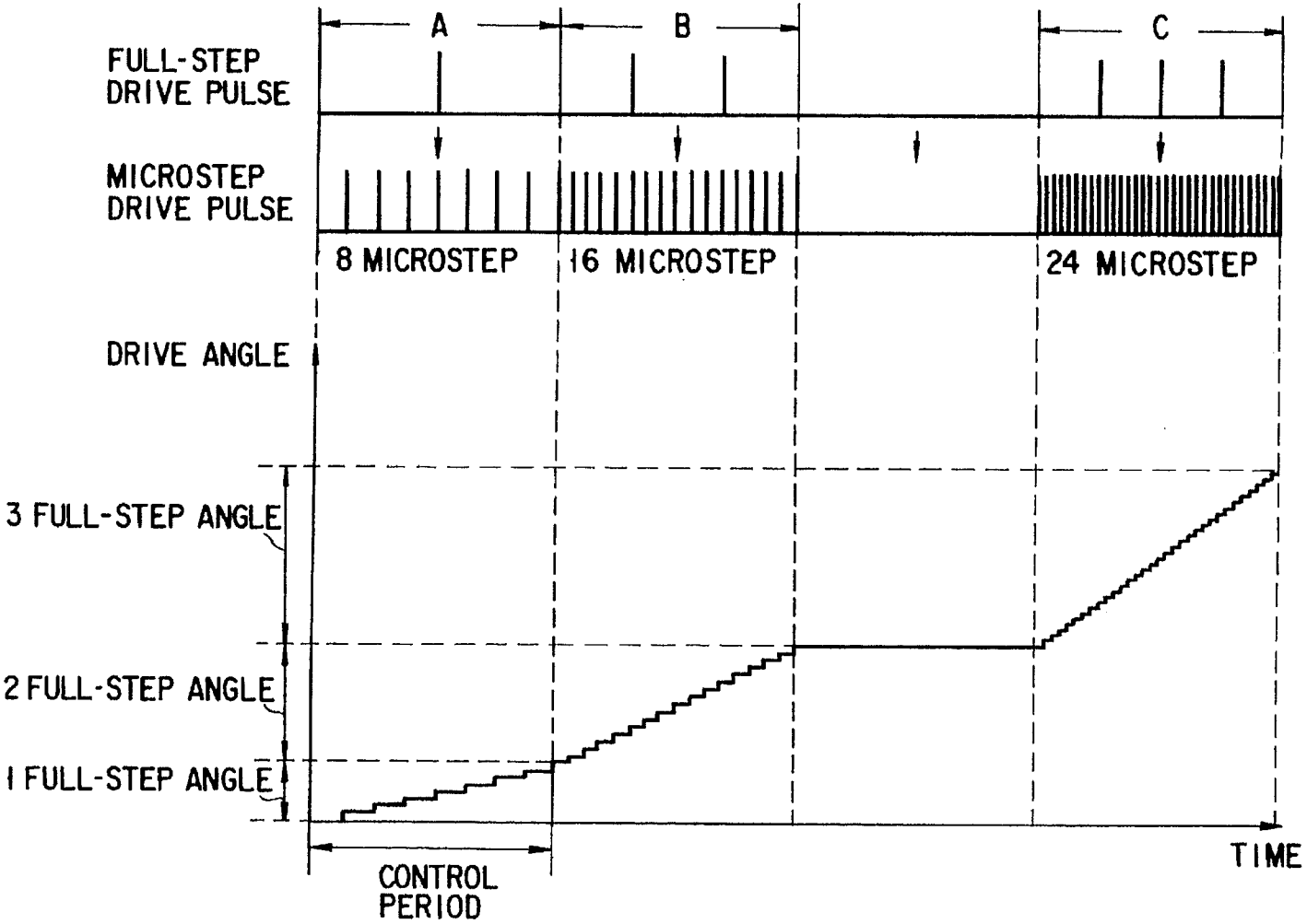
FIG. 2 is a characteristic curve showing a microstep drive state in FIG. 1.
Figure 3:
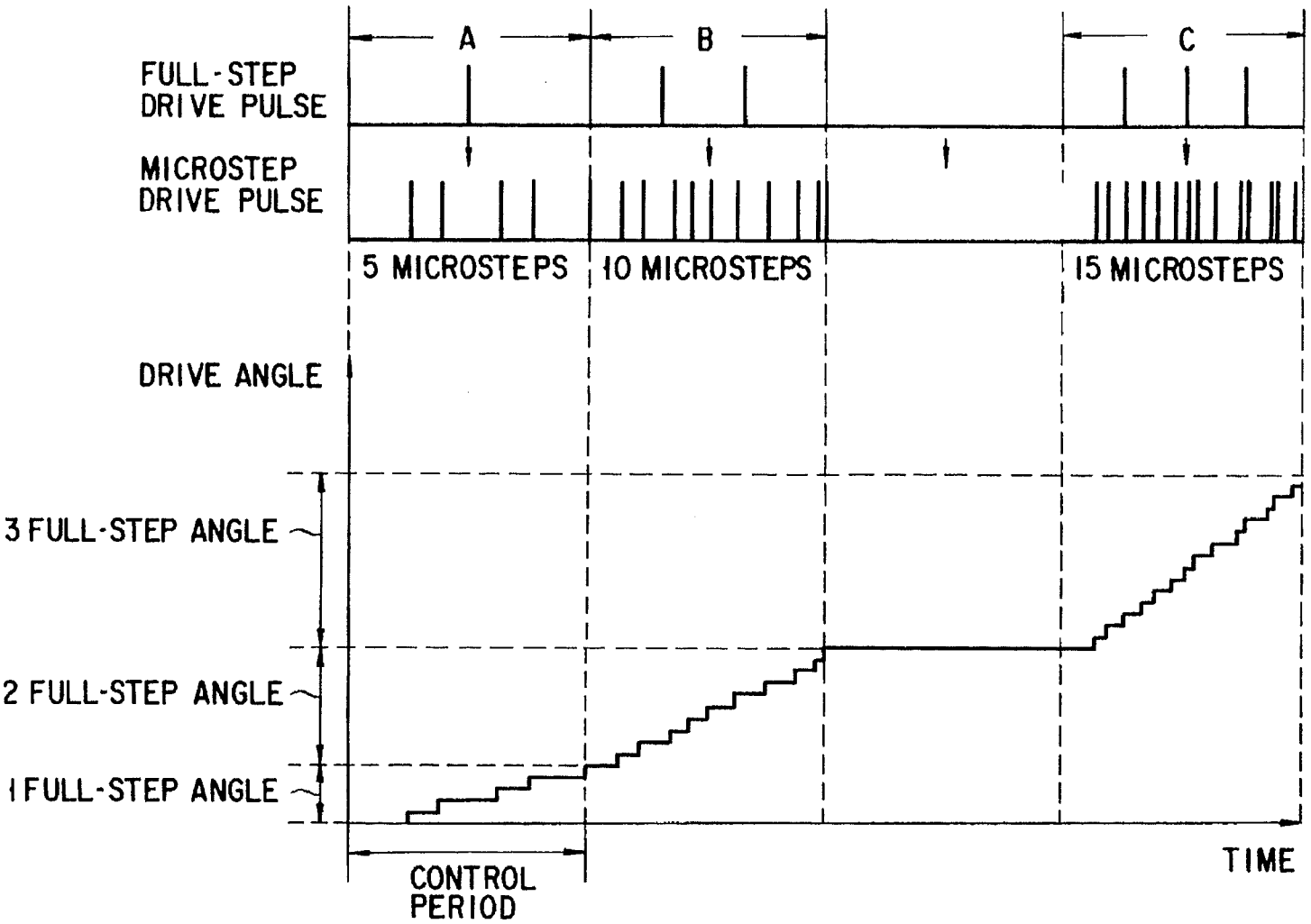
FIG. 3 is a characteristic curve showing another microstep drive state in FIG. 1.
Figure 4:
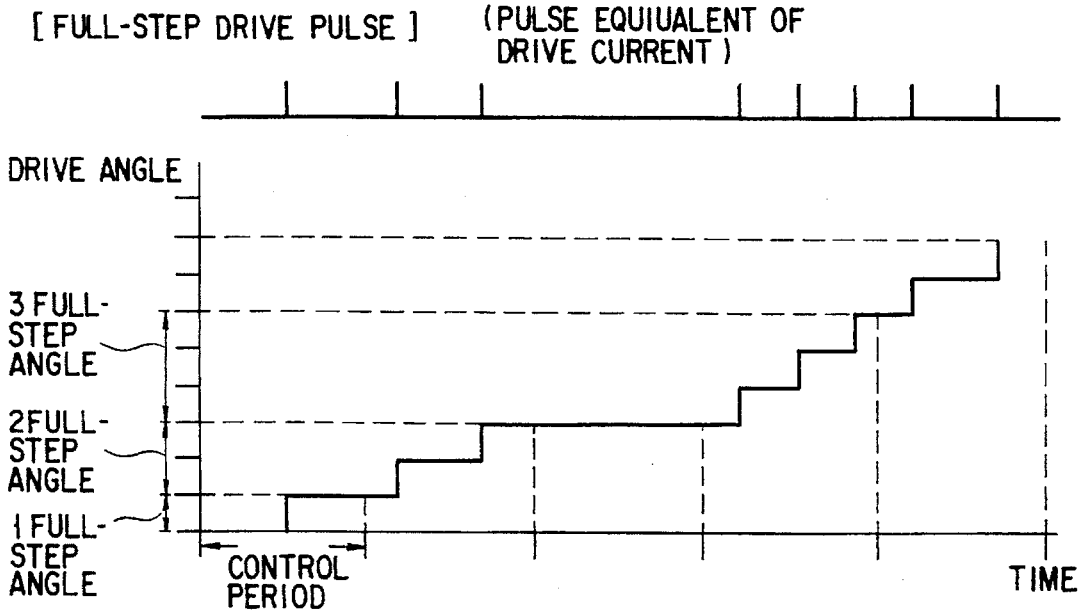
FIG. 4 (PRIOR ART)
FIG. 4 is a characteristic curve showing a conventional stepping motor drive system.
Figure 5:
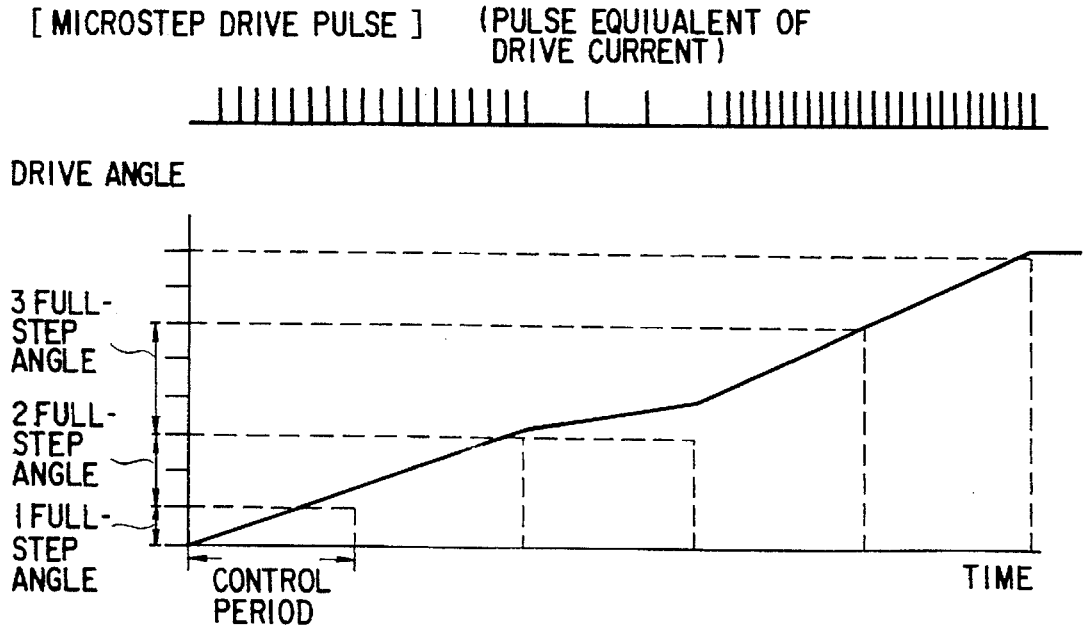
FIG. 5 (PRIOR ART)
FIG. 5 is a characteristic curve showing a conventional stepping motor driven system.

The drive control unit 10 computes, based on the output of the sensor unit 15, the number of full-step drive pulses at an interval A (FIG. 2). In this case, the pulse number is 1.

As appreciated from the drive angle ratio between the full-step drive pulse and the microstep drive pulse, the drive control unit 10 generates eight microstep drive pulses in order to effect a uniform microstep drive corresponding to a full-step angle at that interval A.

In the present embodiment, the number of pulses for microstep drive is eight microstep drive pulses corresponding to an integral multiple of the number of computed full-step drive pulses and drive angle ratio.

The microstep drive pulses of the drive control unit are input to the motor drive unit 11.

The motor drive unit 11 generates a motor drive current in response to the thus input microstep drive pulses and inputs it to the stepping motor 12.

Based on the input motor drive current, the stepping motor 12 drives the antenna drive unit 13 in a microstep drive mode and the antenna 14 controls the orientation of the antenna 14 to a desired orientation direction at the full step angle.

Similarly, during an interval B, the drive control unit generates 16 microstep drive pulses and the motor drive unit 11 generates a motor drive current in response to the input microstep drive pulses.

The stepping motor 12 drives, in response to the input motor drive current, the antenna drive unit 13 in a microstep drive fashion to enable the antenna 14 to have its orientation at a 2 full-step angle controlled to a desired orientation direction.

Similarly, during a period C, the drive control unit 10 generates 24 microstep drive pulses and the motor drive unit 11 generates a motor drive current in response to the received microstep drive pulses.

The stepping motor 12 drives the antenna drive unit 13 in the microstep drive fashion on the basis of the received motor drive current to enable the antenna 14 to have its orientation at a 3 full-step angle controlled to a desired orientation direction.

According to the present invention, the drive control unit 10 computes, at each control period, the number of full-step drive pulses in the case where the stepping motor 12 is driven.

The drive control unit 10 is so operated that, in order to have a drive angle just correspond to the full-step drive at each control period, the unit 10 generates microstep drive pulses whereby the antenna 14 undergoes microstep drive control.

Although, in the present embodiment, the drive control unit 10 computes the microstep drive pulse number as being an integral multiple of the full-step drive pulse number so as to enable a drive to be made uniformly during one control period, the present invention is not restricted thereto. It is possible, according to the present invention, to not only achieve a uniform microstep drive during one control period but also generate not-uniform microstep drive pulses, as shown in FIG. 3, irrespective of the drive speed ratio between the full-step drive pulses and the microstep drive pulses.

In this connection it is to be noted that, even in this embodiment, as in the previous embodiment, the drive amount of the antenna 14 corresponds to a 1 fullstep angle at an interval A, 2 full-step angle at an interval B and 3 full-step angle at an interval C.

In this way, the antenna drive apparatus computes the number of full-step drive pulses at every control period, generates microstep drive pulses, on the basis of the pulse number, to enable a drive angle at each control period to correspond to a full-step unit and is driven with the use of a motor drive current based on the microstep drive pulses.

According to the present invention, the stepping motor 12 is driven with a smooth drive torque in a full-step unit as shown in FIG. 2, thus preventing oscillation caused by a disturbance in the antenna 14 resulting from the driving of the motor. It is, therefore, possible to implement orientation control of the antenna with high stability and high reliability.

Further, according to the present invention, when a power supply of the stepping motor is put in a stopped state, the motor is stopped to a specific position corresponding to a "full-step unit" position, where achieving a smooth antenna drive in microstep drive motion through the utilization of a detent torque involved. This can be reproducibly achieved on the present antenna apparatus.

Such reproducibility is ensured upon the driving of the motor so that the power supply of the stepping motor 12 can be turned ON or OFF without being adversely influenced thereby. Without providing any position control system calling for thermal control consideration as in the conventional apparatus, antenna orientation control can be readily realized with high accuracy and high reliability. It is also possible to turn the stepping motor 12 ON and OFF. According to the present invention an electric power saving can be promoted in comparison with the conventional apparatus. It is proved effective to use the present apparatus in a field of a cosmic development largely calling for an electric power saving in particular.

According to the present invention, accurate orientation control of the antenna 14 can be readily implemented. It is also proved more effective to those applications calling for high orientation control, such as an antenna for a space optical communication system now under investigation in a recent cosmic development for instance.

As an antenna system applicable to the present invention there are a system on a space navigational vehicle, such as a man-made satellite, and an antenna system on the ground.

The present invention is not restricted to the above embodiment and can be variously changed or modified without departing from the sprit and scope of the present invention.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An antenna drive apparatus comprising:

a stepping motor for an antenna orientation;

a control unit for converting drive currents at a control period of the stepping motor to pulses so as to compute the number of full-step drive pulses on the basis of the drive amount of the antenna, and in order to make a drive angle at the control period correspond to a full-step unit, generating microstep drive pulses on the basis of the computed full-step drive pulse number; and a drive unit for driving the stepping motor by the microstep drive pulses generated from the control unit.

2. The antenna drive apparatus according to claim 1, wherein the controlling unit generates microstep drive pulses corresponding to an integral multiple of the computed full-step drive pulse number.

3. In an antenna system equipped with an antenna for transmitting and receiving an electromagnetic wave and an antenna drive apparatus having the antenna orientated by driving a stepping motor, the antenna drive apparatus comprising:

a control unit for converting drive currents at a control period of the stepping motor to pulses so as to compute the number of full-step drive pulses on the basis of the drive amount of the antenna, and in order to make a drive angle at the control period correspond to a full-step unit, generating microstep drive pulses on the basis of the computed full-step drive pulse number; and a drive unit for driving the stepping motor by the microstep drive pulses generated from the control unit.

4. The antenna drive apparatus according to claim 3, wherein the control unit generates microstep drive pulses corresponding to an integral multiple of the computed full-step drive pulses.

5. A microstep drive pulse generating system for an antenna drive apparatus, comprising:

computing means for converting drive currents at a control period of the stepping motor to pulses so as to compute the number of full-step drive pulses on the basis of the drive amount of the antenna; and generating means for generating microstep drive pulses on the basis of the computed full-step drive pulse number so that a drive angle at the control period may be made to correspond to a full-step unit.

6. The microstep drive pulse generating system according to claim 5, wherein the generating means generates microstep drive pulses corresponding to an integral multiple of the computed full-step drive pulse number.

* * * * *